United States Patent [19]

Csillag et al.

[11] Patent Number: 4,935,123

[45] Date of Patent: Jun. 19, 1990

[54] APPARATUS FOR THE CLASSIFICATION OR SEPARATION OF SOLID MATERIALS

[75] Inventors: Zsolt Csillag; Géza Szentgyörgyi; Károly Solymár; Tibor Kálmán; Pái Tóth; Ferenc Rosenmann; János Steiner, all of Budapest; János Morzál, Érd; László Zsemberi, Budapest; Béla Lajtai, Disód; Tibor Legát, Budapest; Ferenc Sitkei, Ajka; Ferenc Valló, Ajka; Balint Szabó, Ajka; Gabor Molnár, Ajka; Sándor Czafit, Ajka, all of Hungary

[73] Assignee: Magyar Aluminiumipari Troszt, Hungary

[21] Appl. No.: 44,429

[22] PCT Filed: Jun. 20, 1986

[86] PCT No.: PCT/HU86/00039

§ 371 Date: Feb. 19, 1987

§ 102(e) Date: Feb. 19, 1987

[87] PCT Pub. No.: WO86/07550

PCT Pub. Date: Dec. 31, 1986

[30] Foreign Application Priority Data

Jun. 20, 1985 [HU] Hungary ..... 2429/85

[51] Int. Cl.[5] ..... B07B 7/86

[52] U.S. Cl. ..... 209/144; 55/345; 209/143; 209/145

[58] Field of Search ..... 209/143, 144, 211, 145, 209/148, 138, 139.1; 55/345, 456, 457

[56] References Cited

U.S. PATENT DOCUMENTS

| | | | |
|---|---|---|---|
| 1,367,635 | 2/1921 | Sturtevant | 209/144 |
| 3,135,684 | 6/1964 | Ackeret | 209/144 |
| 3,362,155 | 1/1968 | Driscoll | 55/457 |
| 3,371,783 | 3/1968 | Meyer et al. | 209/144 |
| 3,461,652 | 8/1969 | Sato | 55/457 |
| 4,382,804 | 5/1983 | Mellor | 209/144 |
| 4,539,105 | 9/1985 | Metcalf | 209/211 |
| 4,569,687 | 2/1986 | Feng | 55/345 |

FOREIGN PATENT DOCUMENTS

| | | | |
|---|---|---|---|
| 1782775 | 7/1974 | Fed. Rep. of Germany . | |
| 2536360 | 2/1976 | Fed. Rep. of Germany . | |
| 2556382 | 6/1977 | Fed. Rep. of Germany . | |
| 2629745 | 1/1978 | Fed. Rep. of Germany . | |
| 2649382 | 5/1978 | Fed. Rep. of Germany . | |
| 2051533 | 3/1979 | Fed. Rep. of Germany . | |
| 2826808 | 12/1979 | Fed. Rep. of Germany . | |
| 214069 | 10/1984 | Fed. Rep. of Germany . | |
| 2942099 | 10/1984 | Fed. Rep. of Germany . | |
| 694219 | 7/1953 | United Kingdom | 209/144 |

*Primary Examiner*—Donald T. Hajec
*Attorney, Agent, or Firm*—Handal & Morofsky

[57] ABSTRACT

The invention relates to an apparatus for the classification of solid materials, preferably that of hard and highly pure materials, comprising a housing provided with an inlet stub, fine fraction outlet stub and a coarse fraction outlet stub as well as vane-crowns. The fluid carrying the material to be separated or classified radially passes through two vane-crowns with the vanes oriented at an angle to the tangent of the vane-crowns. Upon passage through the first vane-crown the separating or classifying chamber is reached whereupon the coarse fraction is separated out and the fluid flows radially through the second vane-crown whereupon the flow becomes axial with the fluid exiting against gravity and the separated material being collected below in a closed storage tank associated with the coarse product outlet stub.

21 Claims, 2 Drawing Sheets

APPARATUS FOR THE CLASSIFICATION OR SEPARATION OF SOLID MATERIALS

BACKGROUND OF THE INVENTION

The invention relates to an apparatus for the classification or separation of solid and in given case of highly pure materials.

For fine classification of solid materials cyclones, hydraulic and dispersive bowl classifiers, spiral air elutriators and centrifuges are used.

The mathematical definition of the flow taking place in cyclones has been unsuccessful so far. The lifting and extracting forces applied to the grains in the flow tube (there is only one in the cyclone) are not constant in the cyclone, hence they are unsuitable for sharp classification. A further disturbing effect is that, due to the shape of the cyclones, the flow-tube does not fill out the full cross section along the horizontal and vertical (intersecting) planes, thus disturbing convection flows develop, further deteriorating the classification capacity. As a result, the cyclones are mainly used, for dust separation, or sludge thickening, instead of classification. However, the cyclones do not function perfectly for dust separation either, because not even the constant intensification of the extracting force towards the center is ensured by run of the flow line.

According to the DE-PS 2 536 360 a cyclone is used for the supply of accelerating air to separate the solid particles of the gaseous medium. In the DE-PS 2 942 099, the separation adjusting nozzle at the outlet of the hydro-cyclone used for sand fractionation is formed to be elliptical to improve the classification.

In case of cyclones used for dust separation (see DE-PS 2 826 808) several holes are arranged on the bottom of the separating chamber between the dust-tube and the storage tank for exhaust of the dust-air mixture.

In the hydraulic and dispersive bowl classifiers laminar upward flow of constant velocity is in a tube or tank, in which only the grains of higher falling velocity than a given limit are capable to fall down upon the effect of gravitation, to be removed by a discharge mechanism from the bottom of the vessel. The fine grains together with the flowing medium leave through the overflow lip of the vessel.

In case of hydraulic classifiers the medium is pressed into the vessel by one or possibly several external pumps. In the apparatuses functioning with gaseous medium, the fan wheel bringing about air circulation is arranged within the classifier on its upper part, generally on the same shaft with the dispersive bowl, the purpose of which is the uniform dispersion of the material in the upward flowing medium. A drawback of the apparatus is that it functions in relatively coarse grain size range, because very low falling velocities are given in the gravitational field, e.g. for the grains smaller than 20 μm. The sharpness of the classification is not satisfactory either, because the laminar flow cannot be provided for. With hydraulic apparatuses the medium entering through the small cross section ought to be distributed at a uniform rate generally in very large cross section, which is an insoluble problem. While in the apparatuses functioning with gaseous medium, the rotation of the fan wheel produces turbulence. Owing to the inadequately sharp classification, the hydraulic classifiers are generally used as auxiliary aid in mineral preparatory processes, while these types of the classifier are used only where no sharp classification is required, e.g. as intermediate classifier in grinding cycle.

The efficiency of the centrifugal classifiers is poor. Namely, in the centrifuge, extracting force is applied to each grain towards the outer wall of the vessel (to increasing extent). Hence the centrifuges (drum, worm, sieve-types, etc.) are very good for sludge thickening, or dewatering, but as classifiers they function with poor efficiency. The classification is made possible only by the medium flowing in the centrifuge drum perpendicularly to the falling direction of the grain, and the very fine grains not yet settled until the overflow are capable to emerge together with the liquid. This, however, represents a relatively wide range and not a specific size.

Such apparatuses are described in the DE-PS 2 556 382 and 2 649 382.

The spiral classifiers are the presently known sharpest classifiers.

The DE-PS 2 629 745 discloses an approximate mathematical model of the flow. The shape and velocity of the flow tube and the acceleration ratios are such that lifting, extracting forces of the same extent are applied to the grains. Thus these classifiers separate more or less at a specific grain size. Their drawback is partly that the suitable run of the flow line can be accomplished only with the fast rotation of the classifying chamber walls (flat cylindrical space), and partly that as a result of the law of continuity only one side of the space would be confined by a flat surface. Disregarding this aspect results in reduced sharpness of the classification. On the other hand, the presence of rotary parts mechanically (statically) limits the grain size range, in which the classifier is capable to function. Namely, the separated grain size can be controlled by varying the vane angle on the circumference and the rotational velocity of the chamber-wall, which influence the shape of the flow-tube. The output of the machine is limited by the chamber-wall and exhaust fan being mounted on a common shaft, consequently the amount of exhausted air is also limited.

A version of the former classifier is the system where the run of the spirals is controlled by the rotational velocity of the central rotary part provided with radial slots, instead of changing the vane angle. The main drawback of both systems is that the rotary parts wear off at a fast rate upon the effect of the hard grains, consequently they can be used only for the classification of soft materials.

SUMMARY OF THE INVENTION

The object of the present invention is to provide an apparatus which functions reliably and which enables correct separation or classification even in case of very hard materials.

According to the invention, the apparatus for the classification or separation of solid materials comprises a housing provided with an inlet stub, fine fraction outlet stub and a coarse fraction outlet stub as well as a vane-crown, wherein said inlet stub is connected to an annular grinding channel, said outlet stubs are arranged coaxially and vertically, an inlet vane-crown and an outlet vane-crown are provided and the separator or classifying chamber has a rotational hyperboloidal mantle between said inlet and outlet vane-crown.

If the apparatus is used for classification, the angle between the surface of the vanes and the tangent thereof is expressed by the following formula:

$$\theta = \text{arctg}\,\frac{c}{\omega}\sqrt{r}$$

wherein $\omega$ is the nominal angular velocity r is the polar radius (and the radius of the classifying chamber)

c is a constant.

The height of the classifying chamber is then expressed by the following formula:

$$m = \frac{Rm_o}{r}\sqrt{\frac{\omega^2 + c^2R}{\omega^2 + c^2/R - r/}},$$

wherein $m_o$ is the value of m at R, r is the radius of the classifying chamber, R is the value of the outer (nominal) radius of the classifying chamber, $\omega$ is the nominal angular velocity, c is a constant.

If the apparatus is used for separation, the angle between the surface of the vanes and the tangent thereof is expressed by the following formula:

$\theta = \text{arc tg } R \cdot e^{\omega t}$ wherein

R is the outer (nominal) radius of the separator chamber e is the base of the system of natural logarithms $\omega$ is the nominal angular velocity t is the time.

The height of the separator chamber is then expressed by the following formula:

$$m = \frac{m_o}{r}\cdot\frac{R^3}{\sqrt{r + R^3}},$$

wherein $m_o$ is the value of m at R, r is the radius of the separator chamber,

R is the outer (nominal) radius of the separator chamber.

The surfaces in contact with the dust mixture are preferably lined with and/or made of hard material.

The material in contact with the dust mixture should be chemically identical with the grains to be ground, e.g. made of sintered corundum.

The invention is based on the recognition that a sharp classification is dependent on the condition that force of the same intensity should be applied to each grain along the flow-tube. This condition is fulfilled if the radial (centrifugal) acceleration ($a_r$) and the radial velocity components ($v_r$) are constant.

According the equation of the path:

$$\phi = -\frac{2c}{\omega}\sqrt{R - \omega t}$$

From this it follows that r=constant and r=0, because $v_r = r$. If r=0 then $r\phi^2$ from $a_r = \ddot{r} - r\,\rho$must be constant. I.e. $\rho = 1/\sqrt{r}$. r however is a linear function of t (time), i.e. r=f(t), and $\dot{\phi} = c/\sqrt{f(t)}$ (c=constant, r and $\phi$ are the polar coordinates).

On the other hand, the material in the classifier can pass only from the outside towards the inside. Therefore:

$r = R - \omega t$ wherein

R is the external radius of the classifying chamber, $\omega$ is the nominal angular velocity.

By integration of $\dot{\phi}$ the other pair of equations is obtained:

$$\int \phi dt = \int \frac{c}{\sqrt{R - \omega t}}\,dt = -\frac{2c}{\omega}\sqrt{R - \omega t}$$

Equation of the flow line or path:

$$\phi = -\frac{2c}{\omega}\sqrt{R - \omega t}$$

Velocity components:

$v_r = \dot{\gamma} = -\omega(\text{constant})$ $v_\phi = r\dot{\phi} = c\sqrt{R - \omega t}$ Acceleration components:

$a_r = r - r\phi^2 = -c^2$ (constant)

$$a_r = \ddot{r} - r\,\dot{\phi}^2 = -c^2 \text{ (constant)}$$

$$a_\phi = 2r\phi + r\phi = -\frac{c\omega}{2\sqrt{R - \omega t}}$$

The angle between the tangent and radius vector, which determines the vane angle of the inlet and outlet vane crowns may be defined as $$\text{tg}\theta = r/\frac{dr}{d\phi} \text{ and then}$$

$$\theta = \text{arc tg } \phi/2 = \text{arc tg}\,\frac{c}{\omega}\sqrt{R - \omega t}$$

The separated grain size according to Stokes:

$$d = \sqrt{\frac{18\mu v_r}{\Delta\rho a_r}} = \sqrt{\frac{18\mu}{\Delta\rho}}\,\frac{\sqrt{\omega}}{c}$$

where $\mu$ is the dynamic velocity of the medium, $\Delta\rho$ is the difference between the density of the material and the medium.

The velocity along the path is also required for dimensioning:

$$w = \sqrt{v_r^2 + v_\phi^2} = \sqrt{\omega^2 + c^2(R - \omega t)}$$

$$w_{in} = \sqrt{\omega^2 + c^2R}$$

(if t=o) equals the value of air velocity.

The amount of medium admitted into the apparatus ($Q_{in}$) which determines the output can be expressed with the product in the inlet velocity ($W_{in}$) and the inlet cross section ($F_{in}$).

$$Q_{in}=w_{in}F_{in}=w_{in}2R\pi m_o$$

where $m_o$ is the height of inlet vanes.

Finally the profile of the classifying chamber is required to be determined from the continuity condition of the flow:

$$wF=\text{constant.}$$

Its further form:

$$w_{in}F_{in}=w_rF_r,$$

where the right side represents the condition fulfilled in any cross section.

In detail:

$$\sqrt{\omega^2+c^2}R/m_o/=\sqrt{\omega^2+c^2(R-r)}m,$$

from which the height of the classifying chamber in function of the leading radius:

$$m=\frac{Rm_o}{r}\sqrt{\frac{\omega^2+c^2R}{\omega^2+c^2(R-r)}}$$

The value of the expression below the square root equals approximately 1, thus the shape of the classifying chamber is a rotational hyperboloid.

The sharp classification is facilitated by the fact that the medium entering between the vanes moves in flow tubes of the same geometry, hence identical velocities exist in the contact points of the flow-tubes in contact with each other. Thus here in contrast with the cyclones, the flow is troublefree, which means higher inlet velocity and processing capacity. The velocity slows down in the flow-tube of the cyclone consisting of curves winding over each other, hence the velocities are very different in the contact points, i.e. the flow will be disturbed.

Furthermore the invention is based on the recognition, that in case of separation, the flow has to be such, that the extracting force applied to the grains—in the direction opposite the medium—must constantly increase in the direction of discharging the "clean" medium. At constant radial acceleration ($a_r$), the radial velocity ($v_r$) slows down towards the outlet, or the radial velocity is constant and the centrifugal acceleration increases. This latter case is the most favourable. The simplest path curve is obtained as follows.

Expressing the function r as an expression with a value uniformly decreasing in time, e.g.

$$r-Re^{-\omega t},$$

which is easily differentiated, then an expression giving similar but increasing angular displacement, e.g.

$$\phi=Re^{\omega t}$$

which is also easily differentiated. Writing up the basic propositions and those differentiated:

$$r=Re^{-\omega t},\ \dot{r}=-R\omega e^{-\omega t},\ \ddot{r}=\omega^2e^{-\omega t}\text{ and}$$

$$\phi=Re^{\omega t},\ \dot{\phi}=R\omega e^{\omega t},\ \ddot{\phi}=R\omega^2e^{\omega t}$$

the components of velocity and acceleration are obtained.

$$\dot{r}=-R\omega e^{-\omega t}\text{ radial velocity(reduced time)}$$

$$v\phi=r\phi=R^2\omega\text{ axial velocity(constant in time)}$$

$$a_r=r-r\phi^2=R\omega^2(e^{-\omega t}-R^2e^{\omega t})\text{ radial acceleration (increasing in time)}$$

$$a_\phi=2r\phi+r\phi=R^2(\omega^2-2)$$

The angle between the tangent and radius vector, i.e. the vane angle:

$$\theta=\text{arc }tg\left(r/\frac{\partial r}{d\phi}\right)=\text{arc }tg\frac{R^2/\phi}{-R^2/\phi^2}=\text{arc }tg-\phi$$

$$\theta=\text{arc }tg\,Re^{\omega t}\text{ (constant)}$$

Velocity along the path:

$$\omega=\sqrt{v_r^2+v_\phi^2}=\sqrt{R^22e^{-2\omega t}+R^4\omega^2}=R\omega\sqrt{e^{-2\omega t}-R^2}$$

Amount of inlet air:

$$Q_{in}=/\phi_om_o\,R/R\omega\sqrt{1-R^2}$$

Height of the profile determined from the continuity condition:

$$m=m_o\frac{R\sqrt{R+R^3}}{r\sqrt{r+R^3}}=\frac{m_o}{r}\quad\frac{R^3}{\sqrt{r+R^3}}$$

The shape of the profile is a rotational hyperboloid and apart from the diameter of the inlet vane-crown, its shape is not influenced by anything, thus the construction is suitable for the separation of dust particles of any size. The size finally will be determined by the amount of air (or liquid) to be dedusted (desliming).

The minimum grain size to be separated is given by the following formula:

$$d=\sqrt{\frac{18\eta}{\Delta\rho}}\quad\sqrt{\frac{v_r}{a\phi_r}}$$

In case of air and if the definitely separated size is to be obtained, then the data of the inlet air can be reckoned with, hence $$d=1.1256\times10^{-3}\sqrt{\frac{v_{rin}}{a_{rin}}}$$

$$=1.1256\times10^{-3}\sqrt{\frac{-R\omega}{R\omega^2/1-R^2}}\ /\text{cm}/$$

$$=1.1256\times10^{-3}\sqrt{\frac{-1}{\omega(1-R^2)}}$$

BRIEF DESCRIPTION OF THE DRAWINGS

The apparatus is shown in detail in the drawing where.

BEST MODE FOR CARRYING OUT THE INVENTION

Figure 1:
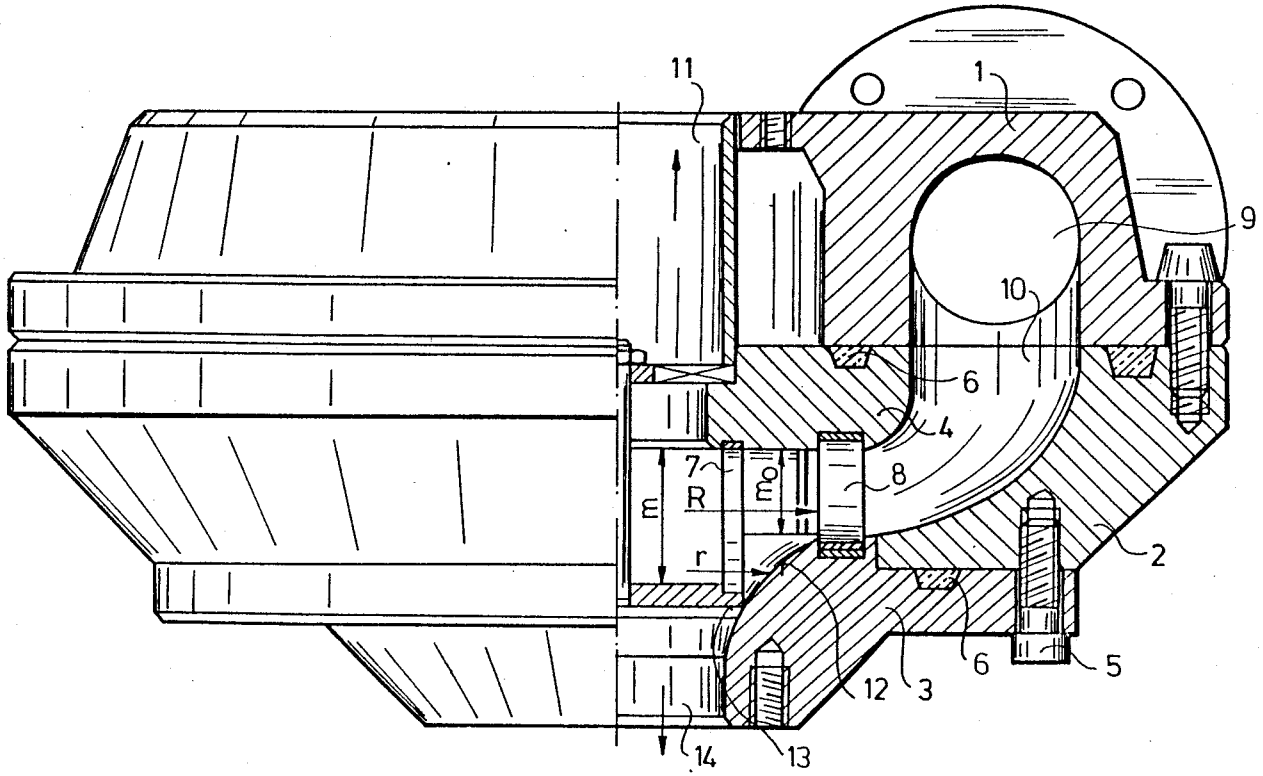
FIG. 1 is the side view of the apparatus, partly in section.
Figure 2:
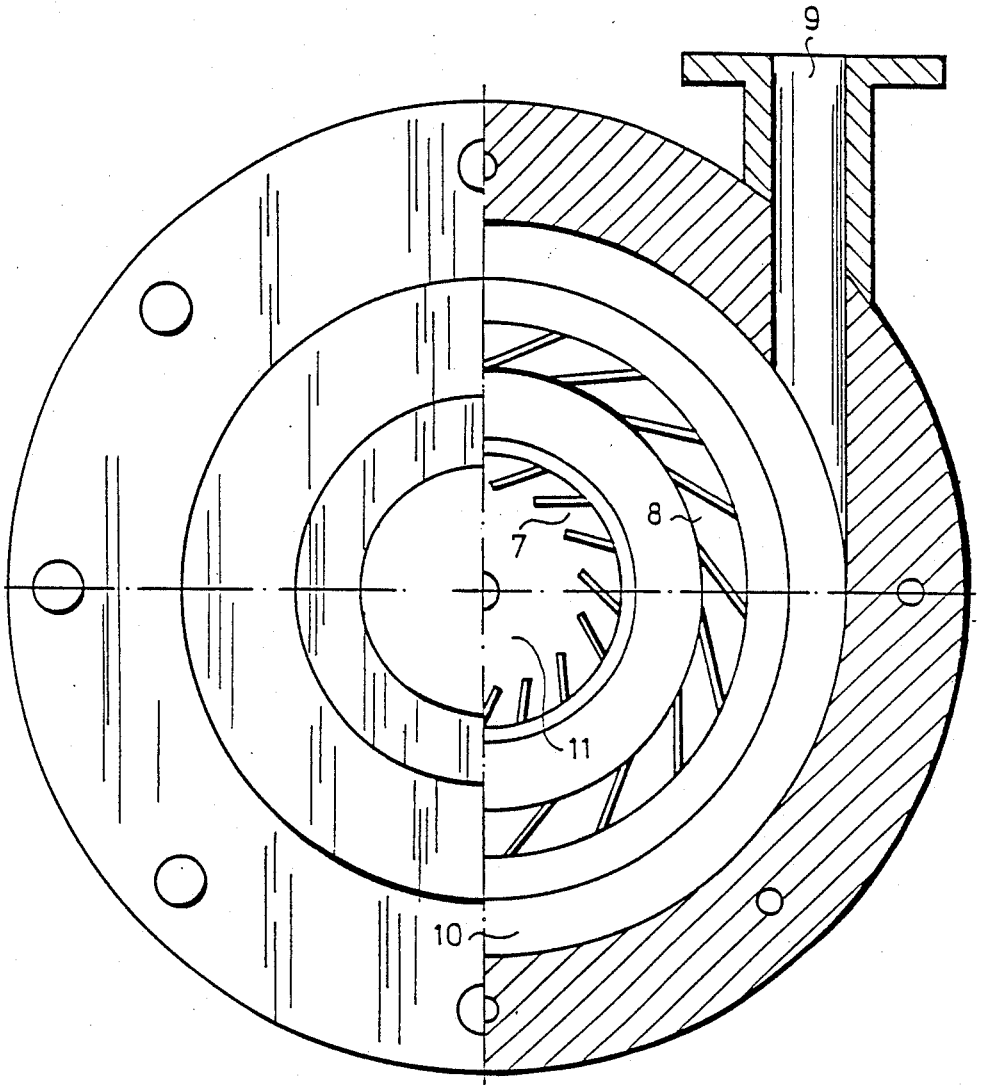
FIG. 2 is a schematic top view of the apparatus, partly in section.

The housing consists of parts 1,2,3 and 4. Said parts are fixed together by screws 5 and O-rings 6 are arranged between them. Outlet vane-crown 7 and inlet vane-crown 8 are arranged within the housing.

A tangential inlet stub 9 is provided on the housing part 1 communicating with a guiding channel 10 for the uniform distribution of the dusty gas (or slimy liquid) on the surface of the inlet vane-crown 8. The dusty gas (or slimy water) entering an apparatus of given radius at an angle determined by the vanes, moves along a path determined by the inlet angle and velocity and by the vane angle of the outlet vane-crown 7, while the classification or dust separation takes place. The fine product and the gas or clean gas emerge from the interior of the outlet vane-crown 7 through the outlet stub 11. The coarse product or dust flows back towards the inlet vane-crown, while due to the effect of gravitation it settles on the bottom of the classifier space, from where it flows out along the hyperbola profile 12 through the gap between the vane-crown baseplate 13 and hyperbola profile 12 and through the outlet stub 14 into a storage tank.

The dust separator and classifier are structurally distinguished from each other in that the inlet and outlet vane angles in the dust separator do not vary according to the operational conditions. On the other hand in the classifier the appropriate path curve is to be formed with the aid of the replaceable vane-crowns according to the variation of the operational conditions (e.g. amount of admitted air).

The inner surfaces of the apparatus in contact with the solid particles and the guide vanes are made of sintered corundum elements, thus they are resistant to the abrasive effect of the hard materials. The resistance is increased by the fact that the apparatus has no fast rotary (moving) parts, thus the relative velocity of the wall and the particles is lower, which reduces the abrasive effect of the grains. The construction of the apparatuses is very simple, consequently the very slowly wearing parts can be replaced easily, quickly and at a low cost.

The cost of operation of the apparatuses is reduced by the absence of moving parts, i.e. they do not require mechanical driving power. Moreover, the flow of medium required for the actuation may be given in certain cases by the waste-energy of the grinders (e.g. jet mills), whereby highly energy-saving processes can be developed.

Advantage of the apparatus according to the invention is that while in the conventional cyclone 85% of the dust is separated and 15% moves further with the air, the separation in this apparatus is 97%. Used as classifier, the amount of faulty product (below or over the size) does not exceed 10 weight % even in case of products between 5 and 7 μm, while this value in the best known apparatuses is around 30%. Since the surfaces in contact with dust, particularly the vane-crowns are made of sintered corundum, the values of classification and dust separation were not deteriorated even after half year operation. If the known apparatuses are running with corundum, the impeller breaks down within a few hours.

We claim:

1. Apparatus for the radial flow classification of solid particulate materials entrained in a fluid, comprising a housing provided with an inlet stub, fine fraction outlet stub and a coarse fraction outlet stub wherein:

(a) said inlet stub is connected to an annular guiding channel, (b) said fine fraction and coarse fraction outlet stubs are arranged coaxially and vertically, (c) an annular inlet vane-crown comprising vanes and having an interior radius and an annular outlet vane-crown comprising vanes are arranged concentrically; and (d) said inlet and outlet vane crowns being provided with a classifying chamber therebetween, through which said materials move with an angular velocity; said chamber having a rotational hyperbolic mantle whereby a fine fraction of said materials passes through said outlet vane crown to said fine fraction outlet stub and a coarse fraction of said materials flows out said chamber along said mantle and through said coarse fraction outlet stub.

2. The apparatus as claimed in claim 1, wherein an angle is defined between the plane of the vanes and a tangent to the associated vane-crown, said angle being expressed by the following formula:

$$\theta = \text{arc } tg \frac{c}{\omega} \sqrt{r}$$

wherein $\omega$ is the nominal angular velocity, r is the radius of the classifying chamber, c is constant.

3. The apparatus as claimed in claim 1, wherein an angle is defined between the plane of the vanes and a tangent to the associated vane-crown, said angle being expressed by the following formula:

$$\theta = \text{arc tg } R\, e^{\omega t}$$

wherein

R is the interior radius of the inlet vane-crown, e is the base of the system of natural logarithms, $\omega$ is the nominal angular velocity, t is the time.

4. The apparatus as claimed in claim 1, wherein the classifying chamber has a height which is substantially expressed by the following formula:

$$m = \frac{Rm_o}{r} \sqrt{\frac{\omega^2 + c^2R}{\omega^2 + c^2(R - r)}}$$

wherein $m_o$ is the value of m at R, r is the radius of the rotational hyperbolic mantle of the classifying chamber.

R is the interior radius of the inlet vane-crown bordering the classifying chamber, $\omega$ is the angular velocity, c is constant.

5. The apparatus as claimed in claim 4, wherein the vane-crowns are replaceable.

6. The apparatus as claimed in claim 1, said apparatus having surfaces that contact said particulate materials wherein said surfaces in contact with said particulate materials are lined with hard material.

7. The apparatus as claimed in claim 6, wherein said hard material in contact with the particulate material is chemically identical with said particulate material.

8. The apparatus as claimed in claim 6, wherein said surfaces in contact with the particulate materials are made of sintered corundum.

9. Apparatus for the classification of solid particulate materials, said materials having a coarse and a fine fraction and being entrained in a fluid, comprising:

(a) a housing;

(b) an inlet stub with an interior surface contacting the particulate materials and said fluid carrying said materials;

(c) an annular guiding channel with an interior surface connected to said inlet stub;

(d) an inlet vane-crown, having an interior boundary and an exterior perimeter defining a tangent, comprising individual vanes oriented at an angle to the tangent of the perimeter of said vane-crown, the exterior of said vane-crown forming an inner boundary of said annular guiding channel;

(e) a space forming the classifying chamber, through which said particulate material moves with an angular velocity, with an interior surface, an exterior boundary, of radius R, formed by said interior boundary of said inlet vane-crown and a rotational hyperbolic mantle of radius r;

(f) an outlet vane-crown, having a base and a perimeter defining a tangent, concentric with said inlet vane-crown, comprising individual vanes oriented at an angle to the tangent of the perimeter of said outlet vane-crown;

(g) a base plate capping the base of said outlet vane-crown;

(h) a fine-fraction outlet co-axial and communicating with said outlet vane-crown; and (i) a coarse-fraction outlet co-axial and communicating with said space forming the classifying chamber via said rotational hyperbolic mantle.

10. An apparatus as in claim 9, wherein the angles between the vanes and the tangent of the vane-crown perimeter is substantially expressed by the following formula:

$$\theta = \text{arc tg}\,\frac{c}{\omega}\,\sqrt{r}$$

wherein r is the radius of classifying chamber at the boundary formed by the rotational hyperbolic mantle, c is a constant, and $\omega$ is the angular velocity of the particulate materials.

11. An apparatus as in claim 9, wherein the angles between the vanes and the tangent of the vane-crown perimeters is substantially expressed by the following formula:

$$\theta = \text{arc tg}\,Re^{\omega t}$$

wherein

R is the interior radius of the inlet vane-crown, e is the base of the natural logarithm system, $\omega$ is the angular velocity of the particulate material, and t is a residence time of the particulate materials.

12. An apparatus as in claim 9, wherein the classifying chamber has a height which is substantially expressed by the following formula:

$$m = \frac{Rm_o}{r}\sqrt{\frac{\omega^2 + c^2R}{\omega^2 + c^2(R - r)}},$$

wherein $m_o$ is the value of m at the radius R, r is the radius of the classifying chamber at the boundary formed by the rotational hyperbolic mantle, R is the interior radius of the inlet vane-crown, $\omega$ is the angular velocity of the particulate material, and c is a constant.

13. An apparatus as in claim 9, wherein the vane-crowns are replaceable.

14. An apparatus as in claim 9, wherein said interior surfaces contacting said particulate materials and said vane-crowns are made of materials of the same chemical composition as the particulate materials.

15. An apparatus as in claim 9, wherein said interior surfaces are lined with, and said vane-crowns are made of, sintered corundum.

16. An apparatus for the classification of solid particulate materials of fine and coarse fractions entrained in a fluid comprising:

(a) a housing lined with sintered corundum;

(b) an inlet for introducing said fluid carrying said particulate materials;

(c) an annular guiding channel communicating with said inlet and bounded by said housing;

(d) a replaceable inlet vane-crown, having a perimeter that defines a tangent, concentric with, and forming an inner boundary of, said annular guiding channel, said inlet vane-crown comprising individual vanes of sintered corundum oriented at an angle to said tangent of said perimeter of said vane-crown;

(e) an annular space, forming a classifying chamber through which said particulate materials move with an angular velocity $\omega$, bounded at radius R by said inlet vane-crown and at radius r by a rotational hyperbolic mantle;

(f) a replaceable outlet vane-crown, having a bottom and a perimeter that defines a tangent, concentric with said inlet vane-crown, comprising individual vanes of sintered corundum oriented at an angle to said tangent of said perimeter of said outlet vane-crown and a base plate capping the bottom of said vane-crown;

(g) a fine fraction outlet, co-axial and communicating with said outlet vane-crown; and (h) a coarse fraction outlet, co-axial and communicating with said annular space forming the classifying chamber via said rotational hyperbolic mantle;

wherein the angles between the vanes and the tangent to the vane-crown perimeters is expressed by the following formula:

$$\theta = \text{arc tg}\,\frac{c}{\omega}\,\sqrt{r}$$

wherein c is a constant, and said classifying chamber has a height which is substantially expressed by the formula:

$$m = \frac{Rm_o}{r} \sqrt{\frac{\omega^2 + c^2R}{\omega^2 + c^2(R - r)}}$$

wherein $m_o$ is the value of m at the radius R and, c is a constant.

17. An apparatus as in claim 16, to be used for separation wherein the angles between the vanes and the tangent to the vane-crown perimeters is substantially expressed by the following formula:

$\theta = \text{arc tg } Re^{\omega t}$ wherein e is the base of the natural logarithm system and t is a residence time of said particulate materials, and the height of the separator chamber is substantially expressed by the formula:

$$m = \frac{m_o}{r} \frac{R^3}{r + R^3}$$

wherein $m_o$ is the value of m at radius R.

18. Apparatus for the radial flow separation of solid particulate materials entrained in a gaseous medium, comprising a housing provided with an inlet stub, cleaned air outlet stub and a dust outlet stub wherein:

(a) said inlet stub is connected to an annular guiding channel, (b) said cleaned air and dust outlet stubs are arranged coaxially and vertically, (c) an annular inlet vane-crown comprising vanes and having an interior radius and an annular outlet vane-crown comprising vanes are arranged concentrically; and (d) said inlet and outlet vane crowns being provided with a separating chamber therebetween, through which said materials move with an angular velocity; said chamber having a rotational hyperbolic mantle whereby cleaned air passes through said outlet vane crown to said cleaned air outlet stub and dust flows out said chamber along said mantle and through said dust outlet stub.

19. The apparatus as claimed in claim 18, wherein the separation chamber has a height which is substantially expressed by the following formula:

$$m = \frac{M_o}{r} \frac{R^3}{\sqrt{r + R^3}},$$

wherein $M_o$ is the value of m at R, r is the radius of the rotational hyperbolic mantle of the separation chamber, R is the interior radius of the inlet vane-crown bordering the separation chamber.

20. Apparatus for the separation of solid particulate materials entrained in a gaseous medium comprising:

(a) a housing;

(b) an inlet stub with an interior surface contacting the particulate materials and said gaseous medium carrying said materials;

(c) an annular guiding channel with an interior surface connected to said inlet stub;

(d) an inlet vane-crown, having an interior boundary and an exterior perimeter defining a tangent, comprising individual vanes oriented at an angle to the tangent of the perimeter of said vane-crown, the exterior of said vane-crown forming an inner boundary of said annular guiding channel;

(e) a space forming the separation chamber, through which said particulate material moves with an angular velocity, with an interior surface, an exterior boundary, of radius R, formed by said interior boundary of said inlet vane-crown and a rotational hyperbolic mantle of radius r;

(f) an outlet vane-crown, having a base and a perimeter defining a tangent, concentric with said inlet vane-crown, comprising individual vanes oriented at an angle to the tangent of the perimeter of said outlet vane-crown;

(g) a base plate capping the base of said outlet vane-crown;

(h) a cleaned air outlet co-axial and communicating with said outlet vane-crown; and (i) a dust outlet co-axial and communicating with said space forming the separation chamber via said rotational hyperbolic mantle.

21. An apparatus as in claim 20, wherein the separation chamber has a height which is substantially expressed by the following formula:

$$m = \frac{M_o}{r} \frac{R^3}{\sqrt{r + R^3}},$$

wherein $M_o$ is the value of m at the radius R, r is the radius of the separation chamber at the boundary formed by the rotational hyperbolic mantle, and R is the interior radius of the inlet vane-crown.

* * * * *